US005799525A

United States Patent [19]

Johnson et al.

[11] Patent Number: 5,799,525

[45] Date of Patent: Sep. 1, 1998

[54] TOOLING AND METHOD FOR THE EMBOSSING OF A CONTAINER AND THE RESULTING CONTAINER

[75] Inventors: Brian D. Johnson, Sinclairville; Randall E. Carr, Ellicottville, both of N.Y.

[73] Assignee: Aluminum Company of America, Pittsburgh, Pa.

[21] Appl. No.: 694,710

[22] Filed: Jul. 19, 1996

[51] Int. Cl.[6] ..... B21D 51/26

[52] U.S. Cl. ..... 72/105

[58] Field of Search ..... 72/105, 106, 379.4; 220/671, 674

[56] References Cited

U.S. PATENT DOCUMENTS

| | | | |
|---|---|---|---|
| D. 283,011 | 3/1986 | Moloney et al. | D9/398 |
| D. 290,688 | 7/1987 | Moloney et al. | D9/398 |
| 744,231 | 11/1903 | Puddefoot | 72/105 |
| 2,630,204 | 3/1953 | Lichtenberg | 198/33 |
| 3,048,512 | 8/1962 | Nelson | 156/14 |
| 3,126,309 | 3/1964 | Manas et al. | 156/566 |
| 4,266,685 | 5/1981 | Lee, Jr. | 220/74 |
| 4,519,232 | 5/1985 | Traczyk et al. | 72/133 |
| 4,538,439 | 9/1985 | Frei | 72/105 |
| 4,773,718 | 9/1988 | Weitzen et al. | 350/3.61 |
| 4,814,784 | 3/1989 | Pallmeyer | 343/882 |
| 4,854,442 | 8/1989 | Krooss | 198/400 |
| 4,954,044 | 9/1990 | Chizaki | 414/754 |
| 5,201,984 | 4/1993 | Bedin | 156/566 |
| 5,255,775 | 10/1993 | Buehren et al. | 198/395 |
| 5,261,261 | 11/1993 | Ramsey | 72/105 |
| 5,261,558 | 11/1993 | Claydon | 220/671 |
| 5,349,837 | 9/1994 | Halasz et al. | 72/94 |
| 5,360,314 | 11/1994 | Provost et al. | 414/755 |
| 5,397,021 | 3/1995 | Usui | 220/667 |
| 5,413,244 | 5/1995 | Ramsey | 220/671 |
| 5,586,681 | 12/1996 | Policappelli | 220/674 |

FOREIGN PATENT DOCUMENTS

| | | | |
|---|---|---|---|
| 0572758 | 3/1992 | European Pat. Off. . | |
| 4367432 | 12/1992 | Japan . | |
| 247637 | 2/1926 | United Kingdom | 72/105 |

*Primary Examiner*—Lowell A. Larson
*Attorney, Agent, or Firm*—Thomas R. Trempus

[57] ABSTRACT

A cylindrical side wall of a can body has embossed features therein. Tooling for the embossing of a can body include male and female tooling members. The male member has protuberances of various elevations that apply embossed features of various depths to the can body, rendering a can with multi-dimensional features.

7 Claims, 7 Drawing Sheets

TOOLING AND METHOD FOR THE EMBOSSING OF A CONTAINER AND THE RESULTING CONTAINER

FIELD OF THE INVENTION

This invention relates generally to an improved container of the type typically used in the beer and beverage industry and a method and apparatus for manufacturing the same. More particularly, the invention is a tooling system for the further forming or embossing of such containers. The embossed features in the container wall may be congruous with the graphics previously applied to the container and can define a multi-dimensional effect on the container.

BACKGROUND OF THE INVENTION

A two-piece container of the type used in the beer and beverage industry consists of a unitary body and a can end. The unitary body is typically formed through a drawing and ironing process. The can end typically consists of an end shell that is converted into an easy open style end. After the can body is filled with a product the converted end is seamed onto the open end of the body. Two-piece cans are predominantly formed from aluminum sheet product and are the most common type of metal container employed by the beer and beverage industry. Of critical importance in the packaging industry is the desire to enhance the appearance of the container in order to achieve a heightened level of package/product differentiation and consumer acceptance.

Various attempts have been made to enhance the overall appearance of the two-piece drawn and ironed aluminum container. These attempts have been two pronged. On the one hand, various efforts have been made to increase the appearance of the decorated can through the use of additional colors in the graphic art applied on the can body. For example, the decoration of cans has gone from four colors to six colors and now presently to eight different colors that can be applied by a single can body decorator apparatus. On the other hand, efforts have been made to modify the appearance of the container itself by further forming the can body itself. For example, it is known to produce a fluted appearance in the side wall of a can body such as disclosed in U.S. Pat. Nos. Des. 283,011 and Des. 290,688. A method and apparatus for processing containers to produce the designs illustrated in the aforementioned patents is disclosed in U.S. Pat. No. 5,349,837, the contents of which are incorporated herein by reference as if fully set forth.

However, when a can body having a fluted side is pressurized, the fluted appearance on the consumer side of the container is lessened and the overall fluted appearance of the container diminished. The full impact of the fluted side wall may not be realized until the beverage container is opened and its internal pressure equalized with the ambient Additionally, while the fluted features are applied in a predetermined physical pattern, the pattern itself does not have any congruous or predetermined relationship with respect to the graphics that have been applied previously to the can body. The fluted pattern and the existing graphics do not represent an integrated artistic whole that heightens the visual impact of the container. The application of the fluted features is random with respect to the graphics on the container. Accordingly, there remains a long-standing goal in the industry to provide a method and an apparatus that will coordinate the application of further formed features, such features as fluting, with the container's art work. Likewise, it has been a goal in the industry to provide a method for enhancing the appearance of a can body, such that the can body retains the further formed features even when the can's contents are under pressure.

It is therefore an object of this invention to provide both an apparatus and a method for the embossing of a can body side wall to enhance the appearance of the container wherein the embossing is applied in a predetermined manner that coordinates the embossing with the can's existing graphics or decoration.

It is also an object of the apparatus of this invention to provide a can body having features thereon that maintain their integrity even when the contents of the container are maintained under pressure.

It is still another object of this invention to provide a tooling system by which the embossing of the container side wall can be accomplished in such a way that the embossed features define two or more plains of reference that are distinctive from the plain defined by the container side wall.

It is yet another object of this invention to provide a can body that exhibits an enhanced appearance through the application of embossing to the decoration or graphic art previously applied to the can.

SUMMARY OF THE INVENTION

According to the present invention, the side wall of a container is further formed to incorporate a variety of features embossed on the side wall of the container body. Two piece cans dominate the beer and beverage industry. In a two piece can, a drawn and ironed body with a continuous side wall extending from a shaped bottom and an open top is closed by a can end that typically incorporates easy-open features. However, it will be readily appreciated that the tooling of this invention can be used in conjunction with conventional three piece can bodies in which an open ended cylindrical side wall is sealed, top and bottom, by separate end panels.

According to this invention, a tooling set for the embossing of the side wall of a container includes a male and female member. The tooling set is arranged to receive the container thereinbetween, with the container mounted on one member, preferably the female member. The male tooling then engages with the female tooling member such that the container side wall is engaged in a pinch point defined by the adjacent tooling members. With the container retained on the female tooling, the female and male tooling members rotate in opposite directions. The tooling works the side wall of the container, embossing it with features that redefine the surface of the side wall.

The female tooling member has a cylindrical surface that defines therein one or more recessed portions. The male tooling member has a cylindrical surface that defines one or more protuberances extending therefrom and adapted to correspond with the recessed portions of the female member. The combination of the female recessed portions and the male protuberances can be arranged to define a decorative pattern. The male and female tooling members rotate continuously with respect to each other, maintaining a substantially constant relative position between said recessed portions and said protuberances, wherein the continuous side wall of the can body is conveyed between the tooling members, decorative embossed features are formed into the side wall of the can body.

The recessed portions of the female tooling member surface constitute a relief for the corresponding male protuberance which constitutes a punch. The female tooling member recess can be at a depth relative to the surface of the female tooling member cylindrical surface that is sufficient to receive the male protuberance of the greatest elevation therein. The male tooling member can include protuberances of varying elevations with respect to the cylindrical surface of the male tooling member. Not withstanding the relative depth of the female relief, the container side wall will be deformed only to the extent of the size or elevation of the male tooling member protuberance. When a male tooling member is provided with a pattern of protuberances some of which are at a lesser elevation than the greatest of them, the resulting pattern in the embossed side wall will define a multi-plane decorative feature. The result is a container with a textured surface or an embossed design with complex physical characteristics. These surface characteristics created through embossing can be congruous with the traditional decorations applied to a can body, rendering a dramatic package for use, for example, in the beer, beverage, and food industries.

BRIEF DESCRIPTION OF THE DRAWINGS

The above as well as other features and advantages of the instant invention can be appreciated through consideration of the detailed drawings in which.

DETAILED DESCRIPTION OF A PREFERRED EMBODIMENT

Figure 1:
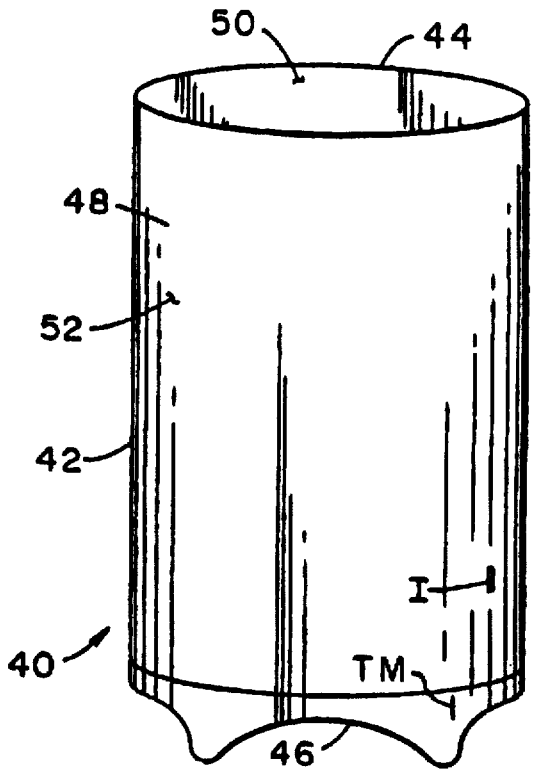
FIG. 1 is a side elevation view of the can body portion of a conventional two piece beer and beverage container prior to the application of the embossing process of the present apparatus.

In FIG. 1, a conventional can body from a two piece beverage container that is well suited for embossing by the tooling of this invention is generally indicated by the reference character 40. The container 40 consists of a can body portion 42 with an open end 44. The body portion 42 includes a bottom portion 46 and a continuous side wall 48 having a beverage side 50 and a public side 52. Two piece cans dominate the beer and beverage industry. In a two piece can, a drawn and ironed body with a continuous side wall 48 extending from a shaped bottom 46 and an open top is closed by a can end (not shown) that typically incorporates easy-open features. However, it will be readily appreciated that the tooling of this invention can be used in conjunction with conventional three piece can bodies in which an open ended cylindrical side wall is sealed, top and bottom, by separate end panels.

The tooling of this invention is ideally suited for use in an apparatus of the type described in assignee's co-pending applications entitled, "Apparatus and Method for the Registered Embossing of Containers" Ser. No. 08/684,114 and "Apparatus and Method for the Embossing of Containers" Ser. No. 08/694,713 both of which are described above.

Figure 2:
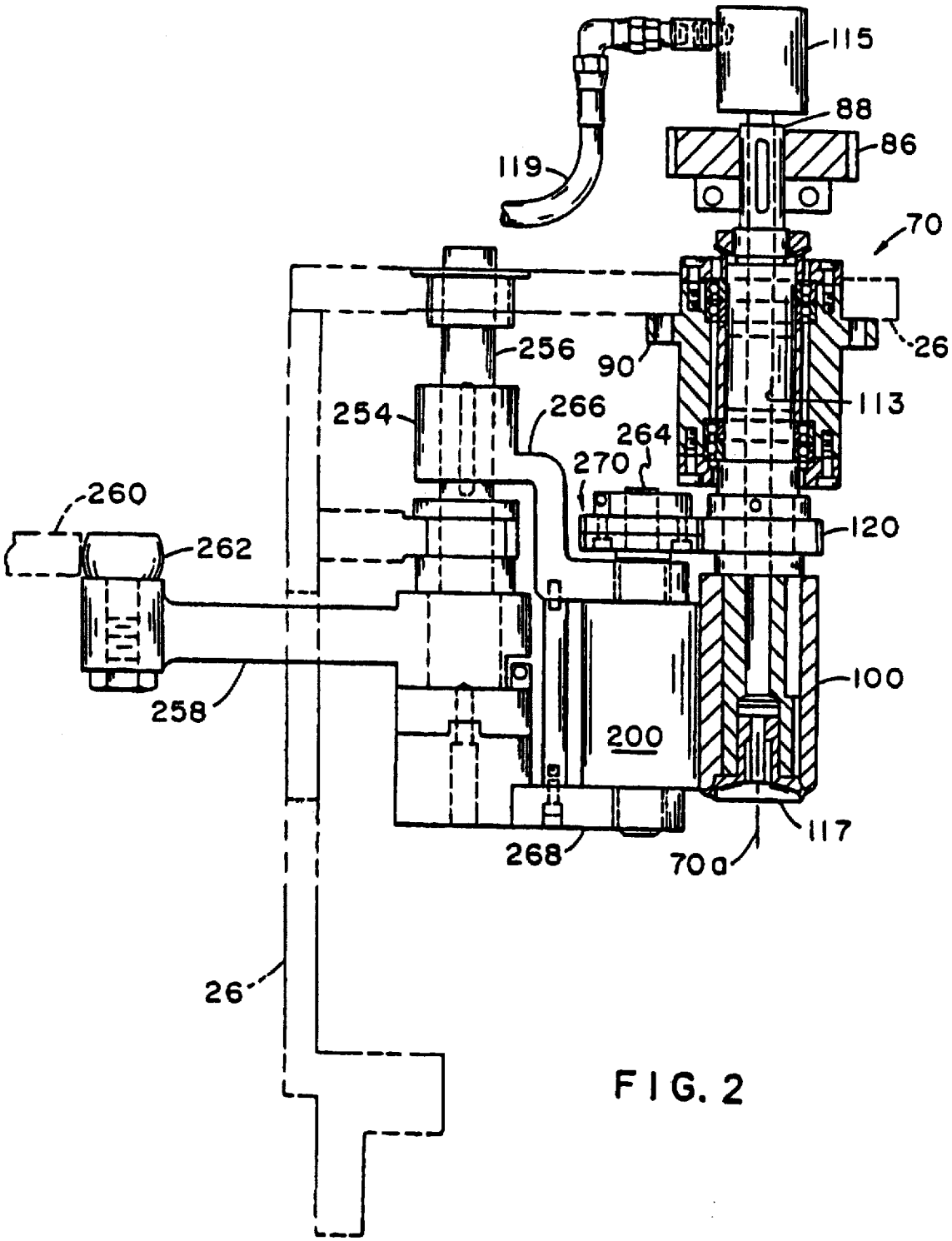
FIG. 2 is a side elevation view of the fixed and movable mandrels on which the tooling members of this invention can be mounted shown in side elevation with portions shown in sectional view.

Turning to FIG. 2, an environment in which the tooling is used is illustrated in combination with a first or fixed mandrel 70 and a second or reciprocating mandrel 76. Each mandrel supports its own tooling member 100 and 200 which together work in concert to emboss the side walls of a container body. The fixed mandrel 70 is mounted for rotation about an axis 70A that is directly above and in alignment with a mechanism for mounting the can body onto the tooling member. The first mandrel 70 is rotationally driven about its fixed axis by means of a gearing system. The shaft 88 is rotationally mounted in the housing 90. The first mandrel 70 is supported within housing 90 for rotational movement facilitated by bearing means 121. The first member is "fixed" in the sense that it rotates about an axis that is in a fixed position. The fixed mandrel 70 supports a first tooling member 100. This tooling member 100 is also referred to as a female tooling member because of its configuration. The support shaft 88 includes a central bore 113 therethrough, extending from the rotary union 115 to the nose piece 117 of the female tooling member 100. Central bore 113 provides a passage through which pressurized air is provided to eject a can body from the female tooling subsequent to the completion of the embossing operation.

The second or movable mandrel 76 is mounted for rotational movement about an axis 76*a* that reciprocates toward and away from the first or fixed mandrel 70. The movable mandrel 76 supports a second or male tooling member 200. The male tooling member 200 cooperates with the female tooling member 100 to effect the embossing of the side walls of the container. The female tooling member has a surface that defines one or more recessed portions therein and the male tooling member has a surface that defines one or more protuberances extending therefrom and adapted to correspond with the recessed portions of the female tooling. The continuous side wall of the can body is conveyed between the male and female tooling members in order to emboss features into the side wall of the can body in a manner to be described in detail below. A main pivot arm assembly 254 is supported for reciprocating rotational motion about the mains support shaft 256. The pivot arm assembly 254 can be provided with a fixed mechanical communication with a lever cam arm 258 or another mechanism for reciprocating the pivot arm assembly to engage and disengage the male tooling member.

At the uppermost end of shaft 264 is mounted an anti-backlash assembly 270. The anti-backlash assembly 270 functions as a spur gear that is in mechanical communication with the spur gear 120 on the shaft 88 of the fixed mandrel 70. Rotation of the first mandrel 70 causes the rotation of the spur gear 120 which in turn is in mechanical communication with the anti-backlash assembly 270 of the movable mandrel 76. This gearing arrangement maintains the uniform rotation of the fixed and movable mandrels as the embossing station with which they are associated is conveyed by the turret around the column. The spur gears on the fixed and movable mandrels move apart, but never completely separate. It is to be appreciated that the reciprocal motion of the second mandrel from the first mandrel need only be enough to provide the clearance necessary to load and to unload the can body from the female tooling of the first or fixed mandrel. In that the current thickness of a can body is approximately 0.004 to 0.006 inches thick, the clearance necessary to load the can body onto the mandrel is relatively small.

After the can has made one revolution through the male and female tooling so as to emboss the can with a full 360° of embossing, the can is removed from the female tooling.

Figure 3B:
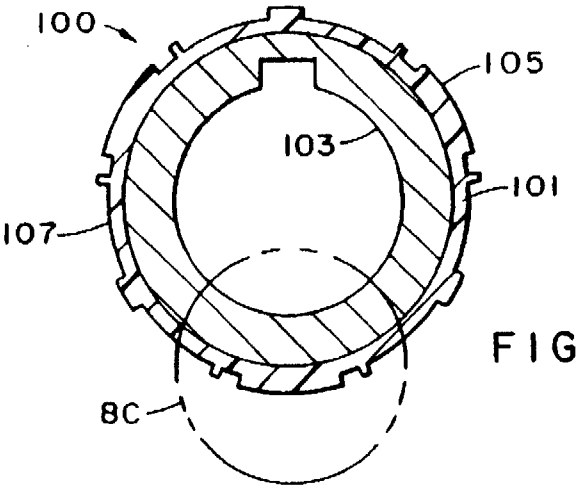
FIGS. 3A, 3B, and 3C are side elevation, sectional, and partial detail views of the female tooling of this invention.
Figure 3C:
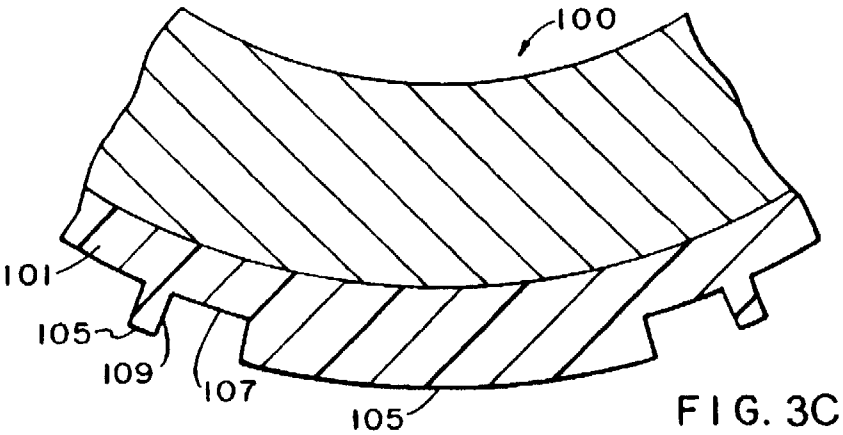
Figure 3A:
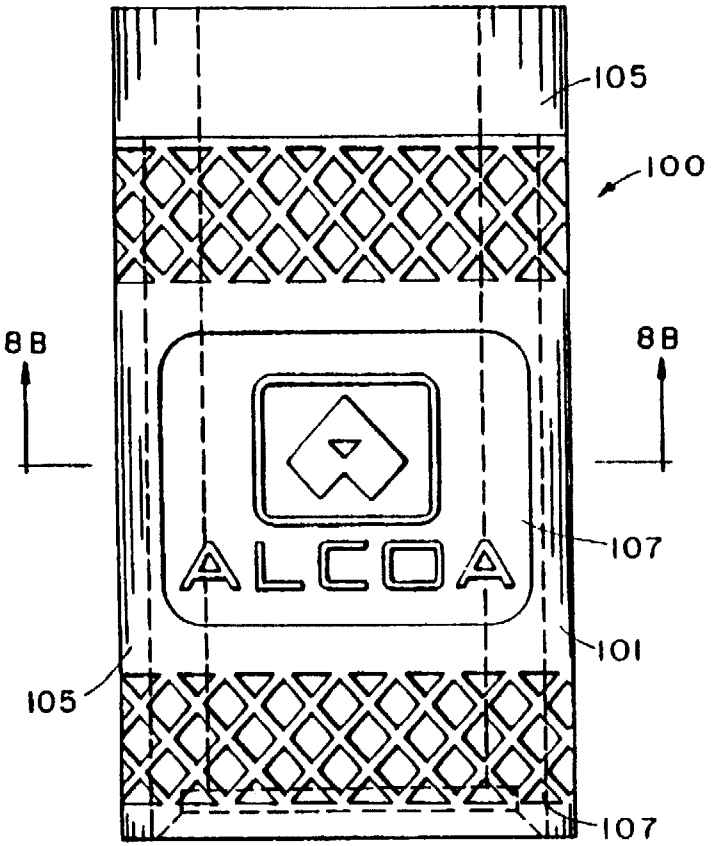

Turning to FIGS. 3, 4, and 5, the female and male tooling 100 and 200 respectively are shown in greater detail. Both the male and female tooling members are made preferably from a polymer material such as polyurethane that exhibits desirable wear and acceptable formability characteristics. Considering first FIGS. 3A, 3B, and 3C, there is illustrated a female tooling member 100 with a cylindrical body portion 101. As can be seen in FIG. 3B, the cylindrical body 101 has a central bore 103 therethrough that is adapted to cooperate with the support shaft 88 of the first mandrel 70 for the mounting of the tooling there on. The maximum outside diameter of the female tooling member is slightly less than the inside diameter of the can body to be inserted onto it for embossing. The outside diameter of the tooling is defined by the outer most surface 105 of the cylindrical body 101. Numerous reliefs 107 are made in the surface of the cylindrical body. As portions of the surface material are removed from the cylindrical body, a pattern can be formed in the tooling member. One exemplar of such a pattern is shown in FIG. 3A in which the trademarks of the assignee are present on the female tooling. The female tooling is in a sense the equivalent to a positive image in photography. The pattern shown in FIG. 3A is, as mentioned, only one example of the vast variety of configurations that can be produced in a female tooling member. It has been found that an appropriate method of forming the tooling is through the use of laser engraving. Extending between the surface 105 of the tooling member and the relief portion 107 are side wall portions 109.

Figure 4B:
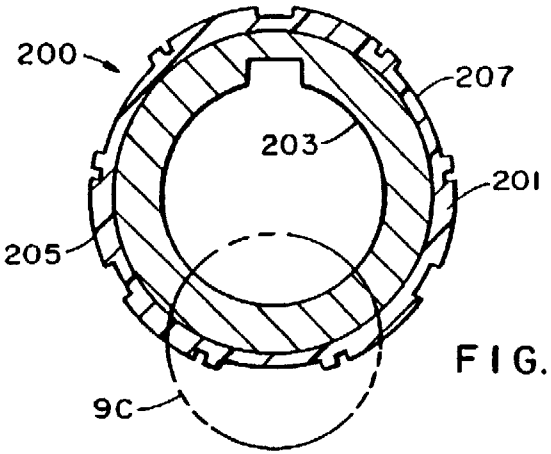
FIGS. 4A, 4B, and 4C are side elevation, sectional, and partial detail views of the male tooling of this invention.
Figure 4C:
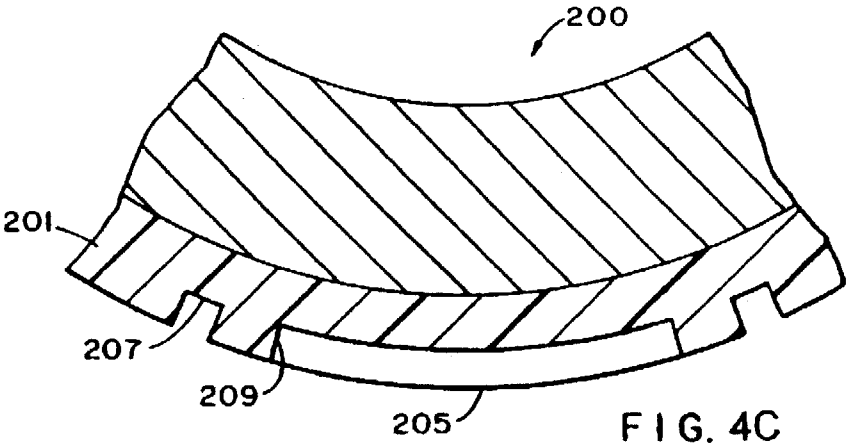
Figure 4A:
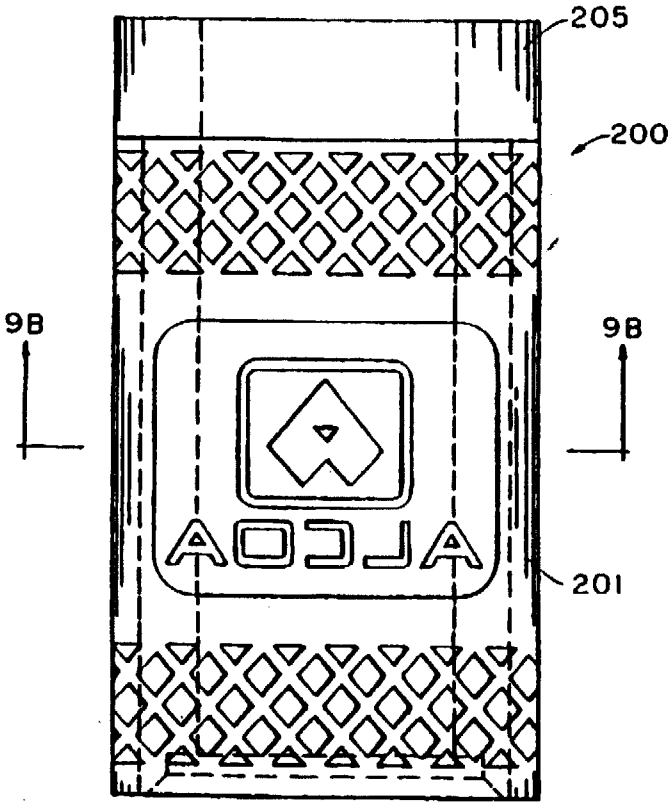
Figure 5A:
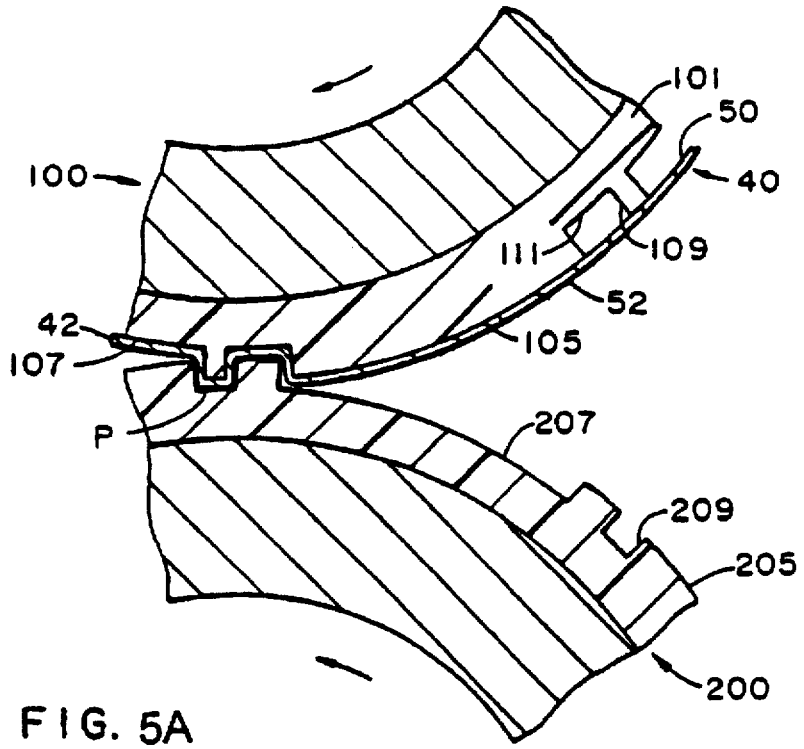
FIGS. 5A and 5B are cross sectional views of a portion of the tooling illustrated in FIGS. 3 and 4 engaging a can body for the embossing thereon.
Figure 5B:
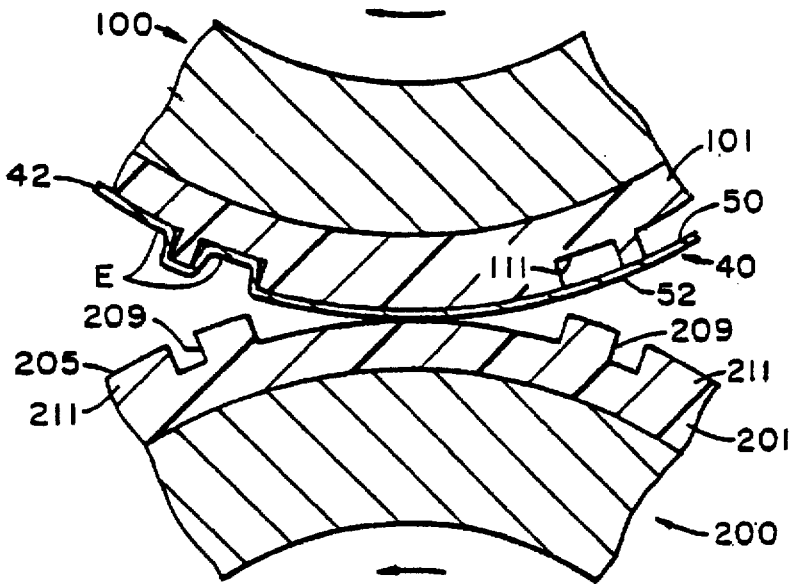

Turning to FIGS. 4A, 4B, and 4C, male tooling member 200 comprises a cylindrical body portion 201 having therein a central bore 203 adapted for mounting the cylindrical tooling member onto the shaft 264 of the reciprocating mandrel 76. The male tooling member is the equivalent of the negative in photography in that the appearance of graphics are reversed. This can be seen by the appearance of the lettering of the assignee's trademark in FIG. 4A. The male tooling member includes numerous protuberances 205 and relief portions 207. Extending there between are walls 209. Turning to FIGS. 5A and 5B, the manner in which the male and female tooling members cooperate to emboss a can body can be readily appreciated.

After a cylindrical container 40 is inserted over the female tooling member 100, the reciprocating mandrel presents the male tooling into a pinch point relationship with the female tooling. As shown in FIG. 5A, as the tooling members rotate with respect to each other, the female tooling member 100 is rotating in a clockwise direction as seen in FIG. 5A and the male tooling in a counterclockwise direction. The container side wall has a thickness of approximately 0.004 to 0.006 inches. This can be seen in FIG. 5A as the pinch point indicated by the reference character P embosses the container side wall 42. Sufficient clearance is provided between the male and female tooling member to allow the container side wall to be further formed by the tooling. The clearance also is sufficient to compensate for the pitch differential between the protuberances generally indicated by the reference character 211 in the male tooling and the recessed portions 111 of the female tooling member 100. Preferably, the protuberances of the male tooling member are approximately 0.010 inches reduced in all directions with respect to the corresponding recessed portions 111 of the female tooling member. In a preferred embodiment, the protuberances of the male tooling engage and emboss the container side wall to a depth of between 0.012 and 0.20 inches. It is believed that the combination of the clearance described above and the use of a polyurethane tooling provides sufficient clearance between the tooling members so as to avoid unnecessary strain on either the container's side wall during the embossing operation or the tooling members' features, i.e., the recessed portions and the protuberances.

Figure 6A:
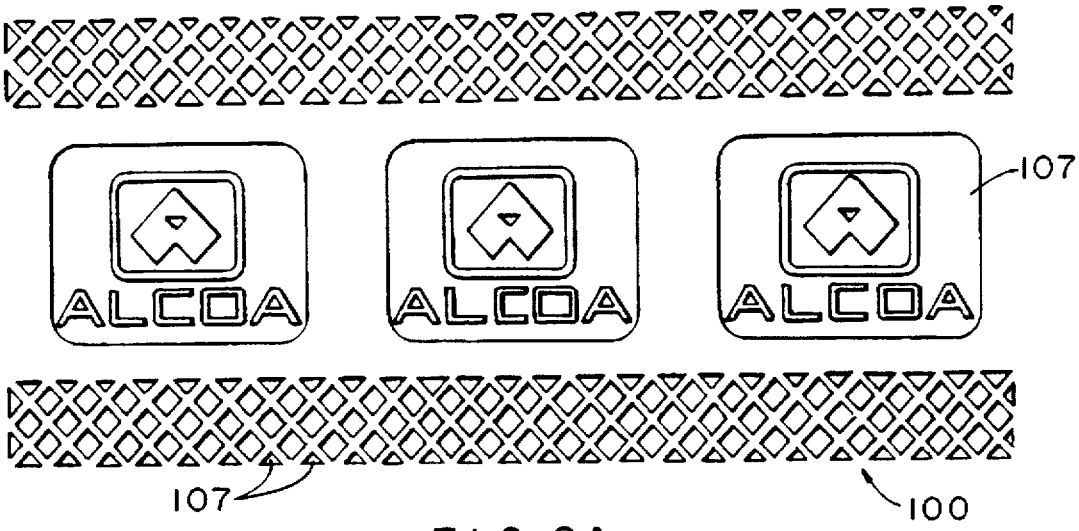
FIGS. 6A and 6B are planar representations of a female and male tooling pattern for full 360 degree cylindrical surface of the tooling and FIG. 6C is a section through the male tooling along lines 6C—6C of FIG. 6B.
Figure 6B:
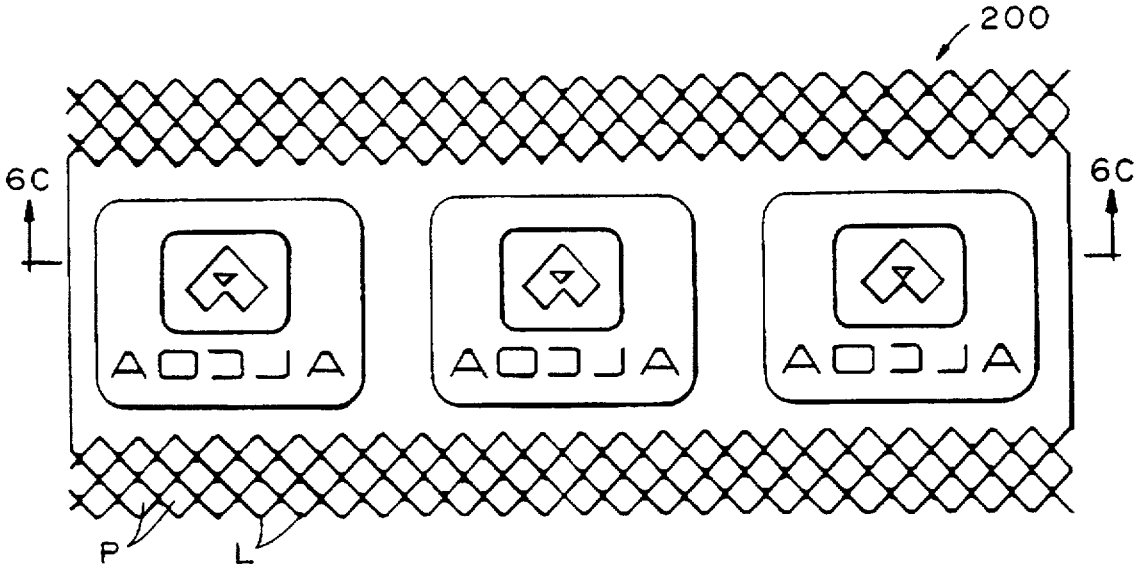
Figure 6C:
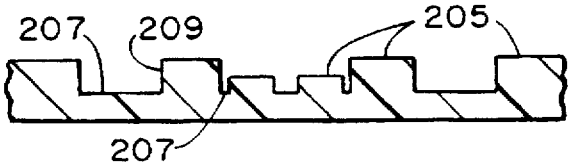

The inventors have found that a container that has embossed side walls in accordance with the tooling of this invention is capable of withstanding the internal pressures typically associated with carbonated beverages. Moreover, even while under such pressures, the embossed can of this invention retains the features of the container side wall. In other words, the embossed features remain visible, as well as pronounced to the touch, even while the contents of the container are under pressure. Another feature resulting from the tooling of this invention is that the portions of the container side wall proximate the embossed locations creates the appearance of being a raised portion of the container side wall. The result is a multi-dimensional effect on the container that presents a pleasing and attractive surface appearance of the container to the consuming public. A variety of embossed features as indicated by the reference character E on FIG. 5B can be incorporated into a can body to provide a can body that has the appearance of the female tooling member illustrated in FIG. 3A. It is to be appreciated that by modifying the relative depth of a relief portion on a female tooling member while increasing the relative height of a corresponding protuberance in the male tooling, a multi-dimensional embossing effect to container side wall is possible. Thus certain features may be more or less pronounced according to the depth and height of the tooling features, rendering a distinctive packaging product. As shown in FIGS. 6A, 6B, and 6C the relief portion 107 of the female tooling 100 are in contrast and the protuberances 205 of the male tooling 200 in white. The lattice work "L" of FIGS. 6A and 6B is formed by protuberances "P" that emboss the region around each cross member. The lattice work of the container shown in FIG. 7 has cross members that are elevated to the touch with respect to the embossed portion, that is the portions of the side wall that have been formed or depressed by the male tooling protuberances "P". The elevation of the protuberances "P" can be of a predetermined elevation, while, for example, the protuberances that define the symbol of the fanciful "A" above the word "Alcoa" can be of a second, different elevation. It should be apparent that three or more different elevations can be employed.

What has been described is a method and apparatus for the embossing of a container side wall and the container incorporating embossed features. While the foregoing invention has been described and illustrated with specific embodiments, it will be understood that the inventions entitled to protection within the full scope of the appended claims.

TOOLING APPLICATION IN A PREFERRED APPARATUS

The tooling of this invention can be mounted in an apparatus for the continuous processing of containers. Two examples of such an apparatus are described in assignee's copending applications entitled, "Apparatus and Method for the Registered Embossing of Containers" Ser. No. 08/684,114 and "Apparatus and Method for the Embossing of Containers" Ser. No. 08/694,713. Briefly, both of these co-pending patent applications disclose an apparatus that includes a turret that is mounted for fixed rotation on a support column. The turret has a plurality of substantially identical embossing stations circumferentially disposed around the periphery of the turret. The turret rotates about the column, sequentially conveying each work station from a can body acquisition station, through loading, embossing, and unloading operations during a portion of the rotational travel of the turret, and finally to a can body discharge station. The can body is delivered to and removed from the apparatus by means of conventional conveyance systems. Other examples of apparatus for the handling of containers are disclosed in U.S. Pat. No. 4,519,232, Method and Apparatus for Necking Containers, U.S. Pat. No. 4,266,685, Can Body and Method for Making Same, the contents of which are incorporated herein by reference.

Each embossing station includes a first mandrel supported for rotation about a fixed axis and a second mandrel supported for rotation about a reciprocating, second axis. The second axis reciprocates between a first location proximate the first axis and a second location distal the first axis in a manner to be described below. The reciprocal movement of the second mandrel is controlled by a cam mechanism disposed on the support column. Each embossing station incorporates a pair of tooling members, each associated with one of the first or second mandrels, one of the pair of tooling members being a female member, the other a male member. The tooling member associated with the first mandrel constitutes the inner tooling member, in that during the embossing operation, the can body substantially encapsulates it. The inner tooling member is in contact with the product side of the container's side wall. Preferably, the inner tooling also constitutes the female tooling member. The tooling member associated with the second mandrel constitutes the outer tooling member, in that during the embossing operation it is in contact with the consumer side of the container's side wall. This outer tooling member constitutes the male tooling member. The inner and outer tooling members when in the first position proximate each other, are sufficiently close so that rotating tooling members engage the continuous side wall of the can body, initiating the embossing of the can body according to the apparatus of this invention. The tooling members are rotated approximately one full revolution (360°) in order to further form substantially the entire continuous side wall.

Both the fixed and the movable mandrel support a tooling member thereon. When the second mandrel is in the first position proximate the first mandrel, both tooling members are positioned to be in contact with a can body that has been loaded onto the first mandrel tooling. In this condition, the tooling of both the first and second mandrel are able to further form the can body. When the second mandrel is in the second position distal the first mandrel, sufficient clearance is provided between the two tooling members to facilitate the loading and unloading of the can body onto and from the tooling.

Each working station also includes a loading mechanism that is in axial alignment with the first mandrel. The loading mechanism is axially reciprocated between a first, can acquisition elevation or position and a second elevation or position for loading and unloading the acquired can body onto and off of the first mandrel tooling member. Cam follower means are provided on the lower end of the loading mechanism and a can body support platform is disposed on the upper end of the loading mechanism. The cam follower means travels along a lift cam circumferentially disposed about the base of the column causing the loading mechanism to reciprocate between the first and second elevations. The can body support platform includes a vacuum means for positively engaging the bottom or dome portion of the can body while the loading mechanism is conveyed about the support column and is reciprocated between elevations.

After the containers are positioned onto the can body support platform, and prior to the loading of the container onto the first mandrel, the support platform begins to rotate the can body at between about 600 to 1200 rpm through the symmetric axis of the can. A sensor means identifies a timing mark that has been previously applied at a location that is proximate the lower or closed end of the can body. The mark can be an integral feature of the printed decorations on the can body side wall or applied to the bottom portion of the container. The loading mechanism includes a servo motor that is responsive to the output of the sensor means. The can body support platform rotates the can body until the timing mark is acquired. Upon acquisition, the rotation is stopped and a predetermined position of the container maintained. With the container now in a know position with respect to the female mandrel tooling, the loading mechanism completes its travel to the elevated position, loading the can body onto the female tooling. The male and female tooling complete the embossing of the can body side walls, resulting in a container in which the graphics are congruous with embossed or further formed features of the side wall.

In operation, as the turret conveys a work station about the support column, the loading mechanism support platform, at a first or lower elevation acquires a can body at the can body loading station. The can body is retained on the support platform by vacuum that maintains the can body in axial alignment with respect to the first mandrel tooling member. The support platform rotates the can body while a sensor system identifies certain indicia, such as a timing mark, on the can body. Upon identification of the indicia, the rotation is stopped and held at a position with respect to the female tooling of the first or fixed mandrel. The loading mechanism, by means of the cam follower, lifts the can body up to the second elevation, inserting it over the first mandrel tooling. Thus, the first mandrel tooling member is engaged with the product side of the side wall of the container. The second mandrel is reciprocated to the first position proximate the first mandrel. The second mandrel tooling is now engaged with the consumer side of the side wall of the container. The second mandrel remains in the first position for approximately one complete rotation of both mandrels about their respective axes, then reciprocates to its second position distal the first mandrel. The can body is removed from the first mandrel tooling, preferably by means of air pressure supplied through a bore at or near the axis of the first mandrel. The loading mechanism re-engages the bottom of the can body, preferably with the benefit of a vacuum system and lowers the can body to the first elevation. The turret continuing its rotation about the column positions the loading mechanism at a can body discharge station.

Figure 7:
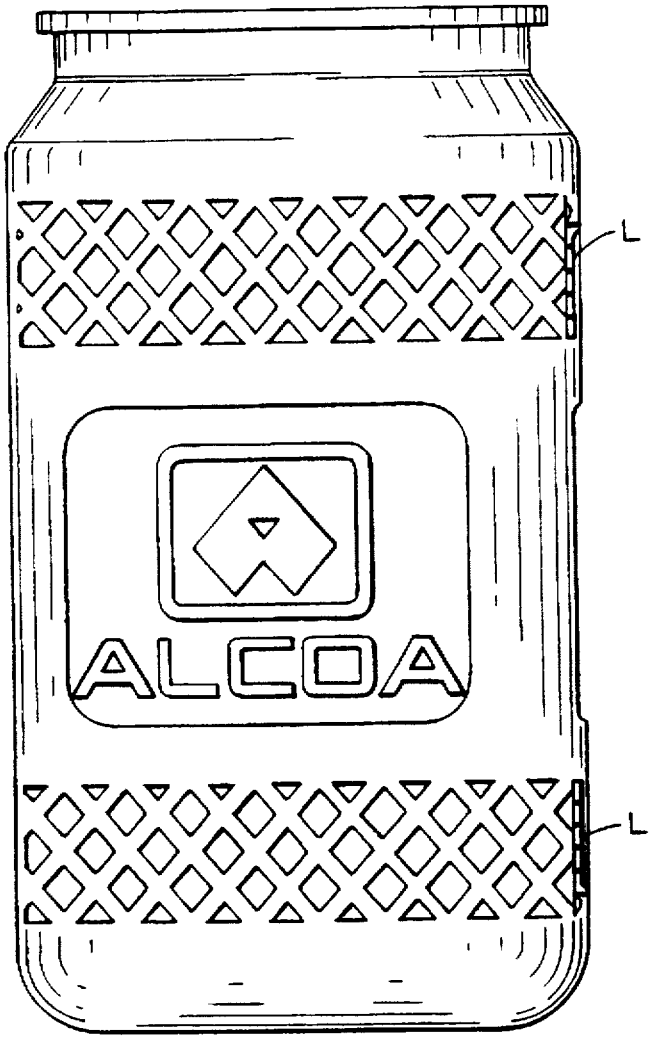
FIG. 7 is a side elevation view of a completely formed can body portion of a conventional two piece beer and beverage container illustrating the multi-dimensional surface features of the method and apparatus of this invention.

Turning to FIG. 7, a can body formed by the method and apparatus of this invention has embossed features of varying depths.

What has been described is a method and an apparatus for embossing containers and an improved container with an embossed side wall.

What is claimed is:

1. A method of embossing a cylindrical side wall of a can body, said side wall having a product side that defines the inside diameter of said can body and a consumer side opposite thereto, said method comprising:

providing a first tooling member having a first cylindrical surface, said first cylindrical surface having an outside diameter that is slightly less than the inside diameter of said can body, said first cylindrical surface defining one or more recessed portions therein;

providing a second tooling member having a second cylindrical surface, said second cylindrical surface defining one or more protuberances extending therefrom, said protuberances adapted to correspond with said recessed portions, such that each individual said protuberance has a corresponding recessed portion, inserting said first tooling member into the can body proximate said product side, engaging the consumer side of the can body with a said second tooling member, conveying the continuous side wall of the can body between the first and second tooling members by the synchronized rotation of said first and second tooling members with respect to each other, wherein the tooling members define a pinch point thereinbetween that embosses the cylindrical side wall of the can body between said recessed portions and said protuberances such that when said can body is received on the tooling member, one complete revolution of the tooling member conveys substantially the entire cylindrical side wall of the can body through the pinch point.

2. The method of embossing according to claim 1 including the step of providing the second tooling member with at least two protuberances extending from the surface thereof and one of said protuberances has a greater maximum projection than the other protuberance.

3. The method of embossing according to claim 2 including the step of providing the first tooling member with a surface having recessed portions of a uniform depth with respect to the surface thereof, said depth being selected to accommodate the protuberance having the greatest elevation.

4. Tooling for the embossing of a cylindrical side wall of a can body, said side wall having a product side that defines the inside diameter of said can body and a consumer side opposite thereto, said tooling comprising:

a first tooling member having a first cylindrical surface, said first cylindrical surface having an outside diameter that is slightly less than the inside diameter of said can body, said first cylindrical surface defining one or more recessed portions therein and adapted to be inserted into a can body;

a second tooling member having a second cylindrical surface, said second cylindrical surface defining one or more protuberances which define an asymmetrical pattern extending therefrom and adapted to correspond with said recessed portions of the first tooling member, such that each individual protuberance has a corresponding recessed portion, wherein the first and second tooling members cooperate to emboss a can body that is conveyed between the tooling members such that one complete revolution of the tooling members is capable of embossing substantially the entire cylindrical side wall of the container.

5. The tooling member according to claim 4 wherein the second tooling member has at least two protuberances thereon extending from the surface thereof wherein one of said at least two protuberances has a different elevations with respect to the surface than the other of at least said two.

6. The tooling member according to claim 4 having a plurality of protuberances there on extending from the surface thereof, wherein at least one of said plurality is of a different elevation with respect to the others.

7. The tooling member according to claim 4 having a plurality of protuberances there on extending from the surface thereof, wherein at least one of said plurality is of a first different elevation with respect to the others and a second of said plurality is of a third different elevation with respect to the others.

* * * * *